United States Patent [19]

Herrmann et al.

[11] Patent Number: 4,807,737

[45] Date of Patent: Feb. 28, 1989

[54] MANUALLY ACTUATED, SELF-COLLECTING PARKING METER

[75] Inventors: Lothar Herrmann, Hornberg; Bernhard Kaiser; Ortwin Woköck, both of Villingen-Schwenningen, all of Fed. Rep. of Germany

[73] Assignee: Kienzle Apparate GmbH, VS-Villingen, Fed. Rep. of Germany

[21] Appl. No.: 8,076

[22] Filed: Jan. 27, 1987

Related U.S. Application Data

[63] Continuation of Ser. No. 699,671, Feb. 8, 1985, abandoned.

[30] Foreign Application Priority Data

Feb. 10, 1984 [DE] Fed. Rep. of Germany ..... 3404752

[51] Int. Cl.[4] ..... G07F 17/24; G07C 1/30

[52] U.S. Cl. ..... 194/293; 194/337; 368/90

[58] Field of Search ..... 194/293, 225, 227, 334, 194/337; 368/90; 74/96, 567, 569

[56] References Cited

U.S. PATENT DOCUMENTS

| | | | |
|---|---|---|---|
| 3,026,983 | 3/1962 | Hamilton | 194/DIG. 22 |
| 3,069,839 | 12/1962 | Johnson et al. | 368/90 |
| 3,391,772 | 7/1968 | Kaiser et al. | 194/DIG. 22 |
| 3,486,324 | 12/1969 | Andersson | 368/90 |
| 3,506,104 | 4/1970 | Kaiser et al. | 194/102 |
| 3,666,067 | 5/1972 | Kaiser | 194/DIG. 22 |
| 3,782,519 | 1/1974 | Zajac | 194/83 |
| 3,913,718 | 10/1975 | Zajac | 194/DIG. 22 |
| 4,607,739 | 8/1986 | Kaiser | 194/337 |
| 4,715,223 | 12/1987 | Kaiser et al. | 194/334 |

FOREIGN PATENT DOCUMENTS

| | | | |
|---|---|---|---|
| 1474749 | 7/1969 | Fed. Rep. of Germany . | |
| 2323567 | 8/1977 | Fed. Rep. of Germany . | |
| 1815601 | 8/1977 | Fed. Rep. of Germany . | |
| 2741474 | 3/1979 | Fed. Rep. of Germany | 194/DIG. 22 |

OTHER PUBLICATIONS

Service Instructions-Kienzle Parking Meter Model PU/PUD6, dated 4/85, 15 pp.

*Primary Examiner*—Robert J. Spar
*Assistant Examiner*—P. McCoy Smith
*Attorney, Agent, or Firm*—Toren, McGeady & Associates

[57] ABSTRACT

A manually actuated self-collecting parking meter includes a single lockable coin insertion device for receiving a range of available coin diameters. A coin checking device is arranged to receive one coin at a time from the insertion device and is placed in operation by turning a rotary locking handle. A parking time period display mechanism is arranged to be set based on the coin inserted into the checking device when the handle is rotated. The rotary locking handle can be rotated in either direction up to a stop for loading a force accumulator which automatically drives an operating mechanism for effecting the operation of the coin checking device and the setting of the display mechanism. For proper phase control of the operating mechanism, a closing segment and an operating segment are provided which uncouple the operating mechanism when the rotary handle is completely rotated so that the automatic operation is carried out.

19 Claims, 15 Drawing Sheets

MANUALLY ACTUATED, SELF-COLLECTING PARKING METER

This is a continuation of application Ser. No. 699,671, filed Feb. 8, 1985, now abandoned.

BACKGROUND OF THE INVENTION

The invention is directed to a manually actuated, self-collecting parking meter including a lockable coin insert device and a coin checking device for handling coins of a range of diameters with the device being actuated by a rotary locking handle. Based on the coin diameter determined by the coin checking device, after the rotary handle has been actuated, a parking time period display mechanism is set. A broad range of manually actuated, self-collecting parking meters are known, which, as a rule, accept up to three different coins. The use of three different coins can be noted on the exterior of the device by the provision of a separate insertion slot for each coin size, such as in the manually actuated parking meters disclosed in the German Offenlegungsschrift No. 18 15 601 or the German Auslegeschrift No. 1 474 749.

The parking meter disclosed in the German Offenlegungsschrift No. 18 15 601 is a manually operated mechanism arranged to accept a maximum of three different sized coins. If, in this known device, the coin units and the time intervals are changed, there is the problem that a whole series of parts and structural members are provided in the form of interchangeable assembly units for the particular coin sizes. Accordingly, in such a known parking meter, it is necessary to provide interchangeable elements for the different coin insertion slots, the coin cams, the coin drive mechanisms, the time setting mechanism, the clock drive mechanism, and the scale graduations so that any combination of coins and time setting selections can be used. If it is considered how many different sized coins and value denominations exist in the worldwide utilization of parking meters and further, if one takes into account the innumerable combination possibilities of the various coins with the associated selection of a parking time period, it is not feasible to maintain in stock interchangeable sets of elements covering all of the possible combinations. Moreover, such a meter would not be economically feasible because of the great number of different parts needed. Furthermore, the use of a parking meter adapted to accept only three different sizes of coins represents a considerable limitation, since the meter cannot be used in boundary regions between different countries where coins of different currencies are used.

Apart from the disadvantages inherent in the changeover of other coin combinations or time calculation factors, a meter arranged to receive three different coin sizes, does not result in an operation completely free of problems. It is necessary to observe certain operating instructions for the parking meter so that the loss of a coin does not take place in the event a coin of the wrong size is inserted into a slot. Many currency systems have been devised so that the higher value coins are formed of previous metals and are of a smaller size than coins of a smaller denomination which are made of ordinary metals. A small but valuable coin can, in most instances, be inserted into a larger slot, however, because of the coin-sorting arrangement within the meter, the coin does not provide a corresponding parking time period, and the return of the coin is, in most cases, not provided.

Another manually actuated parking meter arranged to receive coins of different diameters has been disclosed in the German Auslegeschrift No. 1 474 749. This meter accepts three different sizes of coins each through a different insertion slot. The diameter sorting action takes place by the combined action of several latches including recesses of different depths in relation to the different diameters with corresponding projections on the opposite side of the coin insertion slot. By the movement of the coin in the path of the projections, the latches are correspondingly deflected and engage along the length of the projection with a setting wheel. To change over the coin mechanism to different coin diameters, a replacement of the latches with the recesses is required. In a changeover, inlet elements and the length of the projections must also be replaced by interchangeable parts. The problem of the loss of a coin without gaining any allotted parking time, due to the erroneous insertion of the coin into the slot is not provided for and, as a result, is not solved by this meter.

Generally, in known devices with several coin inlet openings, the person using the parking meter is always responsible for any mistake in operating the device and only after such a loss is the user alerted to observing the frequently sparse operating instructions.

Another manually operated parking meter is set forth in German Offenlegungsschrift No. 23 23 567. In this device only one coin insertion opening is afforded with the various coins inserted being fed into a diameter-sorting part. The diameter-sorting part includes a push lever on which the inserted coin rests, and a coin lever comprising test and adjustment elements for checking a maximum of three coins of different diameters. the push lever includes a certain number of control parts to assure, as much as possible, an accurate test of the inserted coin. While the coin is being checked, the manually actuated push lever moves against the coin lever displaceable in the opposite sense through spring tension. The relative position of the push lever with the coin lever occurring during the checking of a coin, is used to determine an allotted parking time. The transfer into the allotted time mechanism takes place by way of three test levers and latches controlled by the levers, into a time period setting mechanism while the coin is manually directed into a collection box. The adjustment of a usable coin at the driver or follower elements and, further, at the engagement between the test lever and the latch is exceedingly difficult and specific coin tolerances can only be observed with difficulty, if at all. This known coin mechanism can be adjusted only in one rotational direction. Upon insertion of a coin, cumbersome return locking means are activated which prevent movement of the rotary handle into its initial position, until it has been rotated into the end stop position. Such a meter construction encourages illegal operation where the user fulfills his obligation by inserting a coin, but fails to adjust the parking time mechanism to the commencement of a parking period.

SUMMARY OF THE INVENTION

It is the primary object of the present invention to provide a manually actuated, self-collecting parking meter which utilizes coins of a selected diameter range with a coin checking device capable of differentiating without any problems and with the maximum accuracy between at least six or more coins of different diameters.

Further, the meter can be converted into use with different coins and different parking time periods without any effort. Finally, the operating process is simplified and takes place without interfering with the cycle of the parking period selection.

In accordance with the present invention, the parking meter is provided with a heart-shaped cam plate secured on a shaft so that it rotates with the shaft. A rotary locking handle is fixed to the shaft so that by turning the handle, the shaft is rotated and with it the cam plate. The cam plate is in meshed engagement with a winding lever on a winding shaft so that the lever for effecting a setting procedure is actuated by turning the rotary handle in either direction and pivots a gear segment through a coupling pawl for placing the coin checking device in operation and at the same time loading a force accumulator. When the rotary locking handle completes its rotational cycle, an uncoupling action is effected and the lever acts upon a operating mechanism and drives it automatically for checking the coin and then making the selection of the corresponding parking time period based on the coin value.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 3 is rear elevational view of the parking meter with a rear plate and a timing mechanism capable of being screwed on;

FIGS. 9A to 16C are views showing the relation between individual elements of the coin checking device with the Figs. ending in A, representing an initial position of the elements while Figs. ending in B or C, representing operating positions during the adjustment phase of the parking meter; there is no FIG. 16A;

FIGS. 9A, 9B and 9C are views of a testing disc and a setting segment;

FIGS. 16B and 16C are views of the closing segment, the checking element, the control disc and parts of the coin insertion device.

DETAILED DESCRIPTION OF THE INVENTION

Figure 1A:
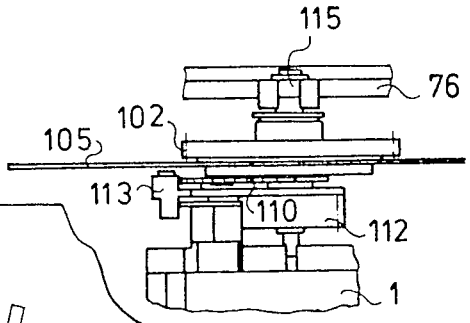
FIG. 1*a* is a detail view of a portion of FIG. 1.
Figure 1:
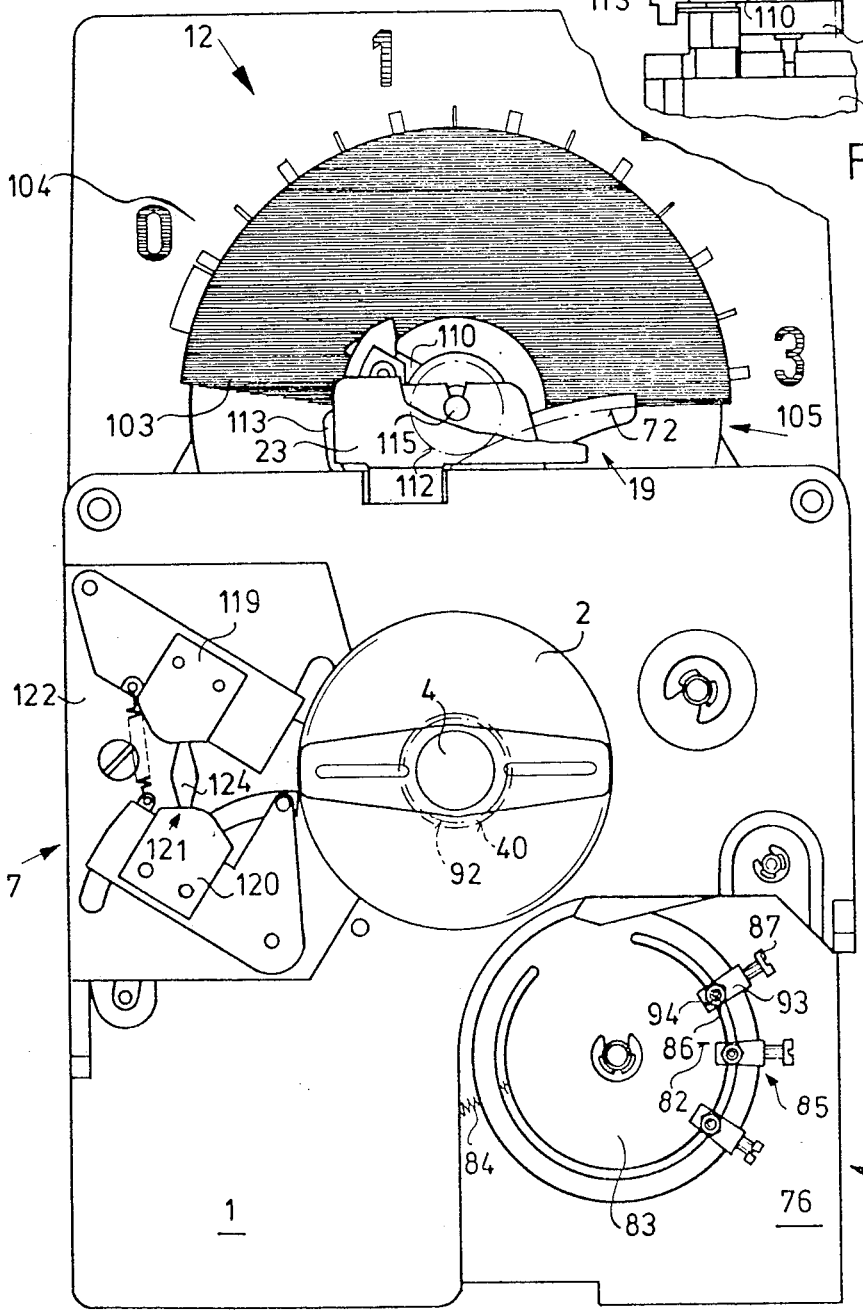
FIG. 1 is an elevational view of the parking meter embodying the present invention viewed from the front, that is, the side facing toward a user, without the housing.

FIG. 1 is the front view of a parking meter embodying the present invention with the housing part removed. In FIG. 1 the front side or the side facing a user is shown. On this front side, a rotary locking handle 2 is secured to a shaft 4 so that it rotates the shaft which is supported in a front plate 1. Screwed onto the front plate 1 is a lockable coin insertion device 7, designed as a compact structural unit, and serving to receive coins 11 of all of the diameters of a given range of coins for directing the coins individually into a coin checking device 8, note FIGS. 4 and 8, described later, and the coin checking device can be actuated by the handle 2. Finally, by inserting a coin 11 intended to be used in the meter. a parking time period display mechanism can be set which, by the displacement of a rotatable time disc 105 with colored markings 103 indicates an allotted parking period on a time scale 104.

Figure 2:
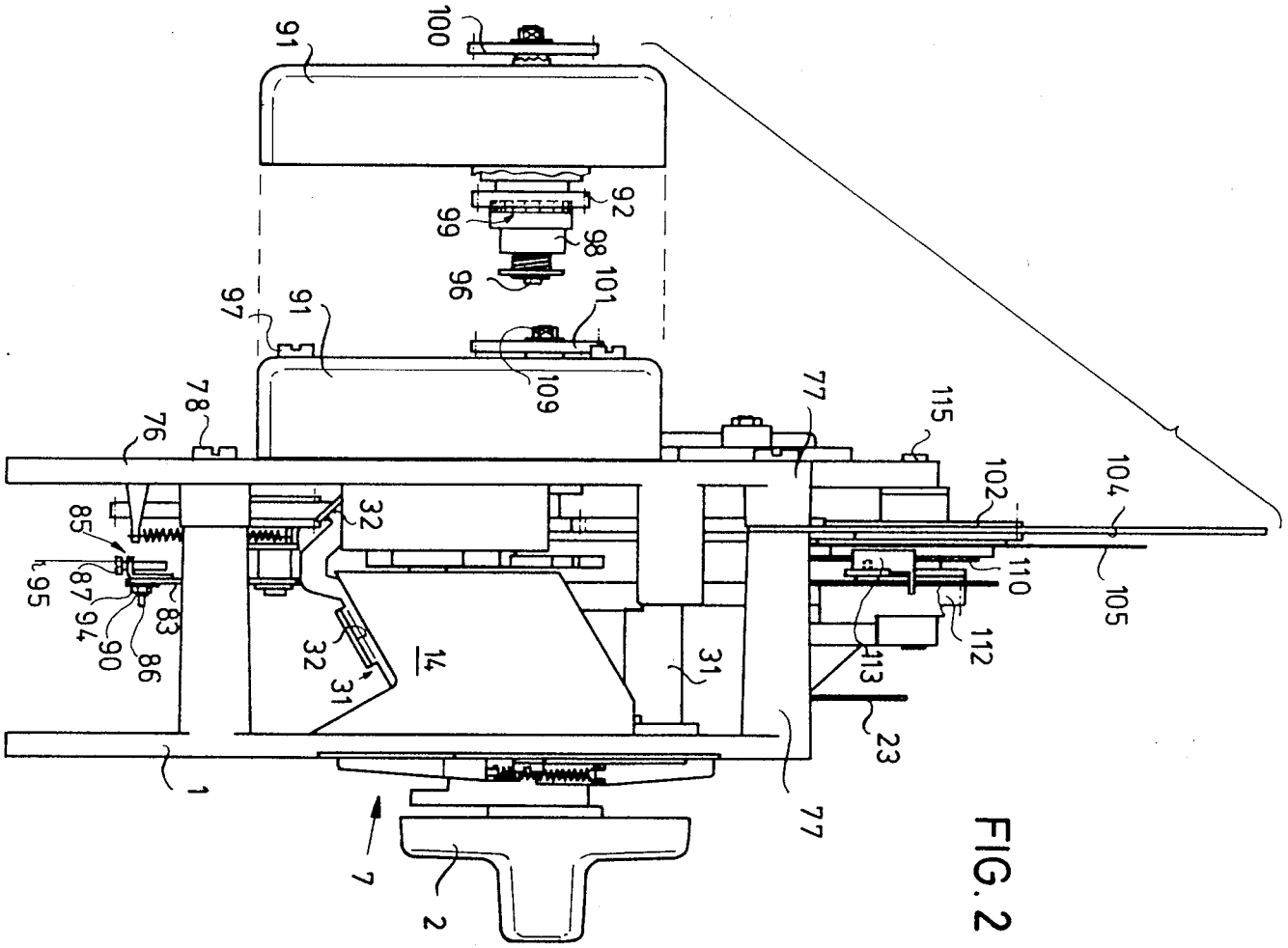
FIG. 2 is an exploded side view of the parking meter in FIG. 1, also without the housing.
Figure 4:
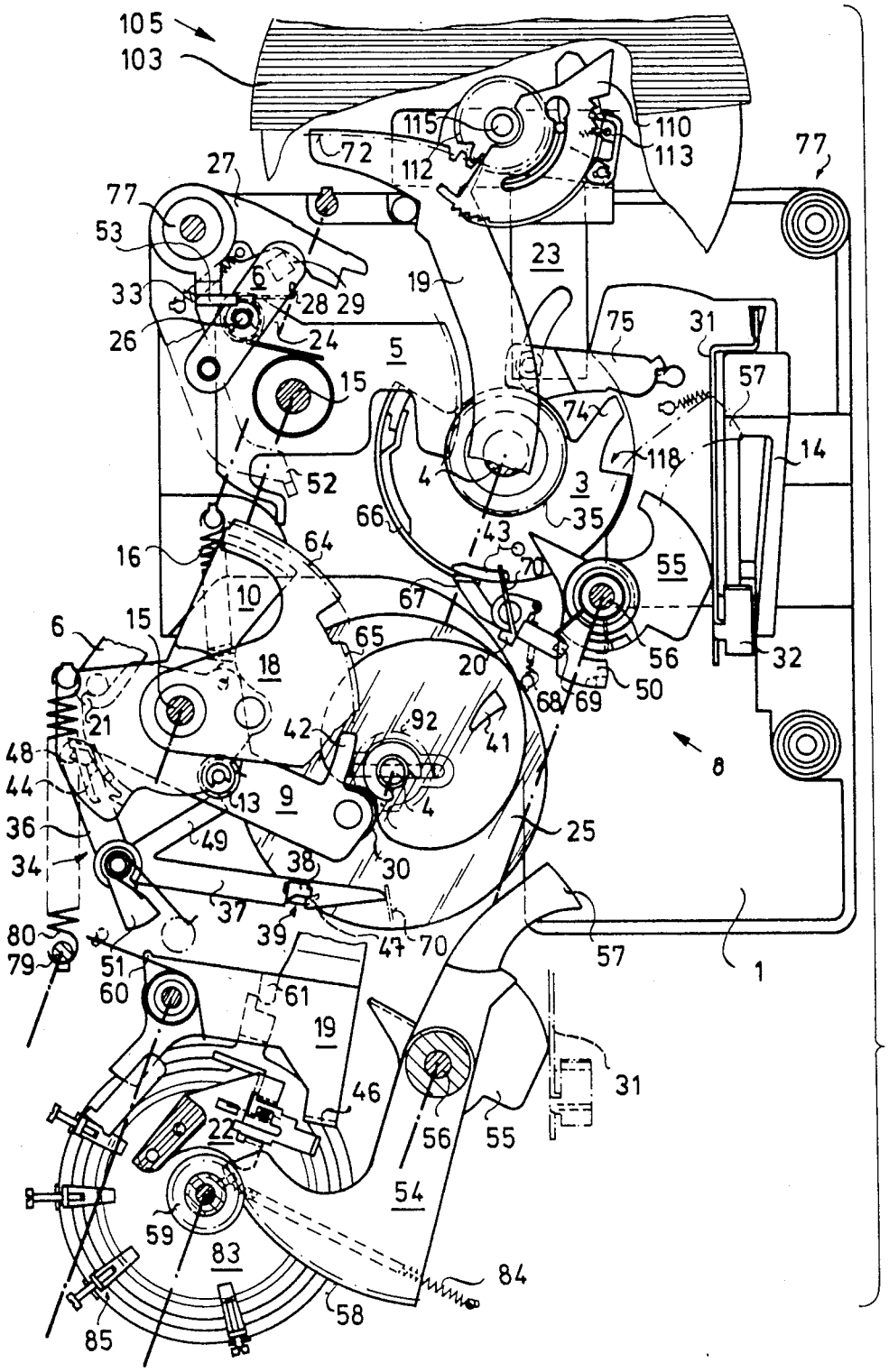
FIG. 4 is an exploded view of the front plate with the rear plate removed and with parts of the operating mechanism and coin checking device displaced out of the normal position.
Figure 13A:
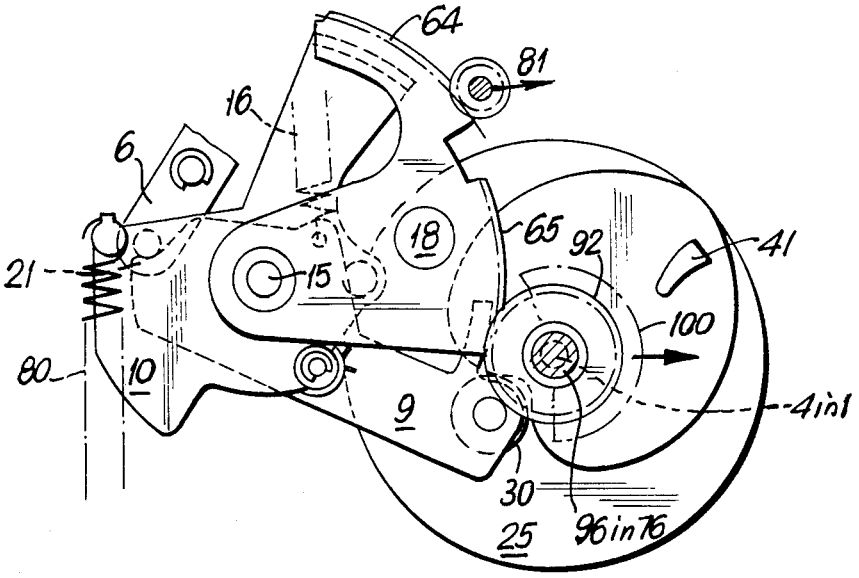
FIGS. 13A and 13B are views similar to FIGS. 11A and 11B without certain elements.
Figure 13B:
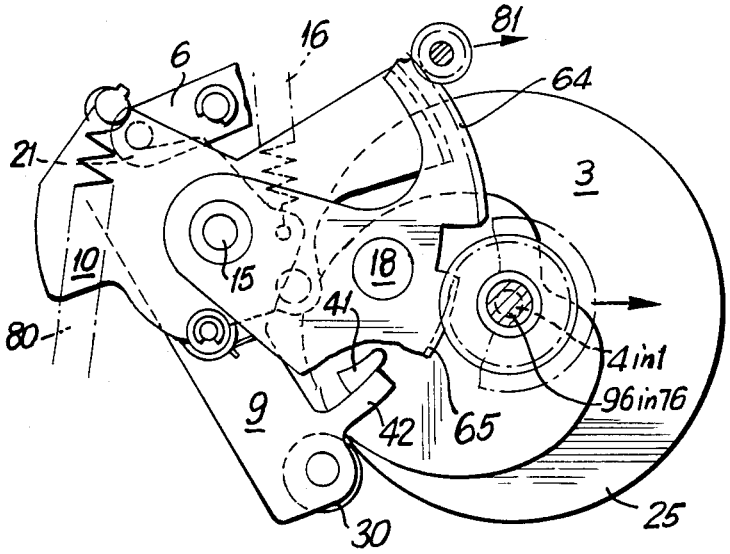
Figure 15A:
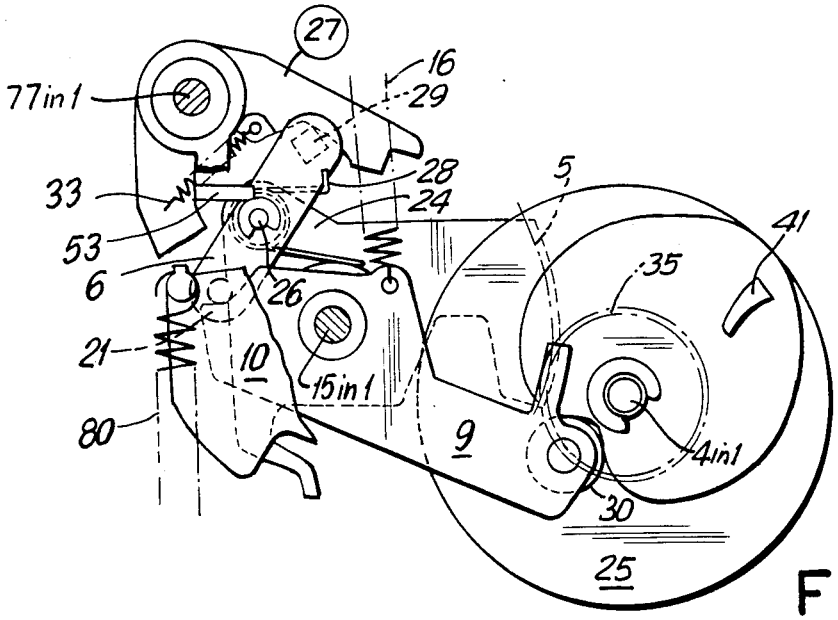
FIGS. 15A, 15B and 15C are views of the operating segment, the tilting lever, a toothed segment and the cam disc.
Figure 15B:
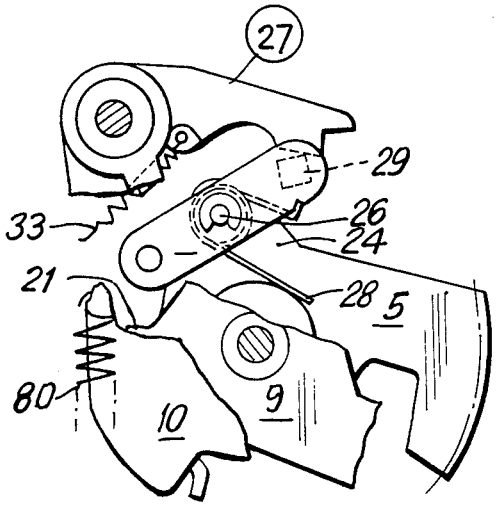
Figure 15C:
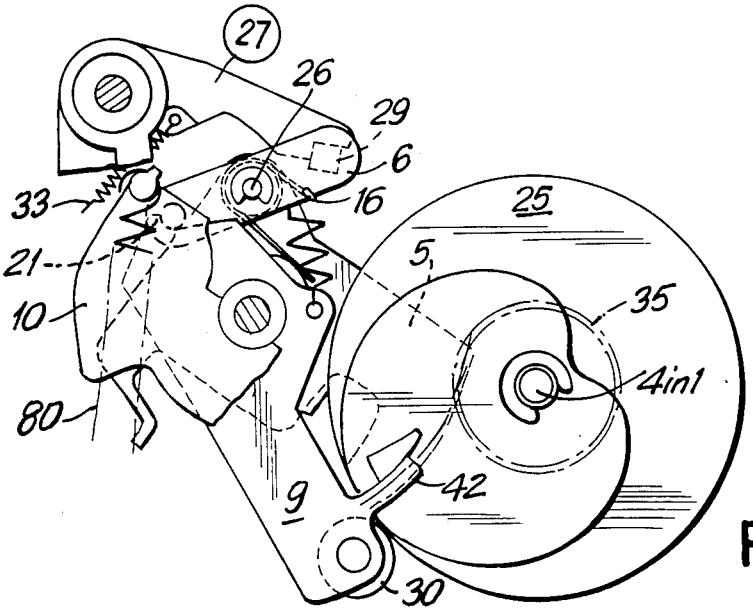

In FIG. 2 a side view of the parking meter is provided illustrating an elapsed time mechanism 91 attached as a separate unit on a rear plate 76 by means of two bolts 97. Due to this arrangement, the time mechanism 91 can be easily replaced. the front plate 1 and the rear plate 76 are assembled by three self-tapping screws 78 extending through cast-on distance posts 77. Prior to tightening the upper screws 78, the time scale 104 is positioned between the distance posts 77. A coin chute 14 is located behind the coin insertion device for guiding a coin 11 into a checking position. In the starting position of the rotary locking handle 2, a gate closure 121 in a coin screen 122 is closed, the gate is controlled by a closing segment 3, note FIG. 5 and the closing segment 3 is rotatably arranged on a hub 40 located on the front plate 1. To open the gate closure 121, a coin is pressed into two pivotally supported closure segments 119, 120 which are in driving connection with a slit gate 124. A pivotal coin lock bar 31 is provided at the end of a coin chute 14, note FIG. 2, and the coin rests on a prism-shaped support 32 so that the coin diameter can be checked. Coin lock bar 31 can be pivoted for releasing the coin after its diameter has been checked and, for this purpose, is in meshed engagement with a control disc 55, see FIG. 4, located on a shaft 56 of the coin checking device 8. A requirement for setting an elapsed time is the actuation of the rotary locking handle 2 after a coin 11 has been inserted, and the handle can be turned in either rotational direction. A heart-shaped cam disc 25, note FIG. 4 and FIGS. 13A and 13B, is secured on the shaft 4 so that it rotates with the shaft. The shaft is turned by the handle 2. The circumferential periphery of the cam disc 25 is in meshed engagement with a tilting level 9 rotatably supported on an axle or shaft 15 and the lever 9 bears against the cam disc over a roll 30 due to the biasing action of a spring 16. Regardless of the direction in which the rotary locking handle 2 is rotated, the tilting lever 9 performs the same pivotal movement due to the symmetrical heart-shape of the cam disc 25. The tilting lever 9 engages by a follower lug 21 into a coupling latch 6 on a toothed segment 5 for operating the coin checking device and, at the same time, for loading a force accumulator 80 in the form of a spiral spring. Toothed segment 5 is coaxial with the tilting lever 9 on the axle 15 so that it does not rotate relative to the axle and includes a cantilever arm 24 on which a support bolt 26 is provided. The coupling latch 6 is rotatably supported on the support bolt 26 and is controlled by a spring 28. The spring acts counterclockwise on the coupling latch 6 and moves the latch into engagement with the follower lug 21 on the tilting lever 9. The coupling latch 6 is constructed as a twin lever and acts via a lever arm 29 together with a multi-arm release lever 27 rotatably supported on the distance post 77 and biased by a spring 33 so that, when the rotating locking handle 2 and with it the tilting lever 9 and the coupling latch 6 are set in the end position, the release lever 27 drops into the coupling latch and uncouples it from the follower lug of the tilting lever 9. See FIGS. 15A, 15B and 15C. The toothed segment 5 with the coupling latch 6 is fixed to the axle 15 so that it does not move relative to the axle and an operating segment 10, FIGS. 4, 5 and 6, and the lifting segment 18 which are pivoted together when actuated by the tilting lever 9 and are fixed on the axle 15 so they are non-rotatable to it. The tilting process is effected by the lever 9 through the coupling latch 6 moving the toothed segment 5 of the operating segment 10 in the clockwise direction as viewed in FIG. 4. The tilting motion is limited by the contact of a cam 41 against an abutment lever arm 42 on the tilting lever 9, note FIG. 5. At the end of the rotation cycle of the handle, the force or energy accumulator 80 is connected to the operating segment 10 and the bolt 79 on the rear plate 76, and the force accumulator is under tension, and when the rotary locking handle 2 is released, the coupling latch is released from the follower lug 21 of the tilting lever 9 through the action of the release lever 27, note FIGS. 15A, 15B and 15C. The connection of the handle 2 with the operating mechanism 34 is interrupted and, as a result, the operation proceeds automatically without any outside manipulation by the handle 2. Only after completion of the operation of the meter can the coupling latch move into engagement for the next operation cycle. When the cam disc 25 is rotated, the tilting lever 9 on shaft 15 rotates clockwise. Shaft 15 is rotated by the parts 21, 6, 26 and the force accumulator 80, a tension spring is stressed. At the end of the rotation cycle of the handle the release lever 27 drops onto the coupling latch 6 and pivots the coupling latch from the engagement position with the follower lug 21 of the tilting lever 9. The handle is thus disengaged and the operating process proceeds under the force of the spring 80 to completion. The coupling latch 6 is immobilized by the release lever 27 until the lever releases the coupling latch at the end of the operating process so that it can drop into engagement with the follower lug 21, note FIG. 5.

Figure 7:
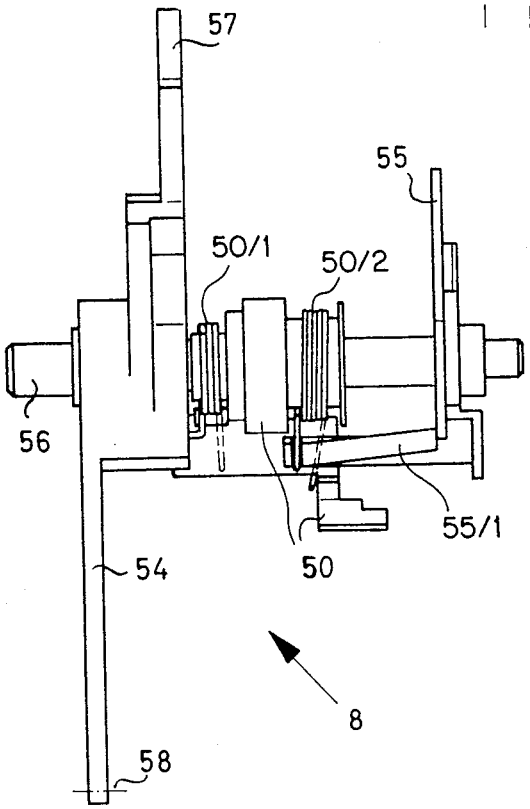
FIG. 7 is a partial side view of the coin checking device operable by the rotary locking handle.

Toothed segment 5 is in meshed engagement with a ring gear 35 on the closing segment 3 and the closing segment is rotatably supported on the hub 40 molded on the front plate 1. When the rotary handle 2 is rotated, the closing segment is moved in the counterclockwise direction as viewed in FIGS. 4 and 5, until an end position is reached through the contact of the cam 41 with one side of the abutment lever arm 42. Closing segment 3 includes a follower 43 and when the closing segment is turned, follower 43 engages a control disc 55 on the coin checking device and the disc 55 is rotatably supported on the shaft 56 extending between the front plate 1 and the rear plate 76. the control disc 55 drives, i.e. rotates, by means of a torsion loaded coupling socket 50, rotatably supported on the shaft 56, a checking element 54 also coaxially supported on the shaft 56. The checking element 54 is designed as a twin lever with one arm forming a scanning member 57 and the other arm forming a toothed segment 58, note FIG. 7. The control disc 55 is contacted by the follower 43, and is rotated from the original position in FIG. 4 into the end position in FIG. 5. The control disc 55, note FIG. 7, is connected with element 50 by an entrainment device 55/1. The entrainment device 55/1 affords rigid entrainment clockwise and flexible entrainment counter-clockwise due to torsional drag spring 50/2, note FIG. 7. The coupling socket 50 is flexibly connected with another torsional drag spring 50/1, see FIG. 7, by a scanning member 57 so that the scanning member 57 can scan any diameter in the range from the largest to the smallest coin, whereby the control disc 55 is always moved through the same angular travel. In case of a coin 11 of a large diameter, the difference between the movement of the control disc 55 to the relatively small rotational movement of the scanning member 57 is compensated by the torsional drag spring 50/1 until contact with the large coin 11.

Figures 5, 5A, 5B:
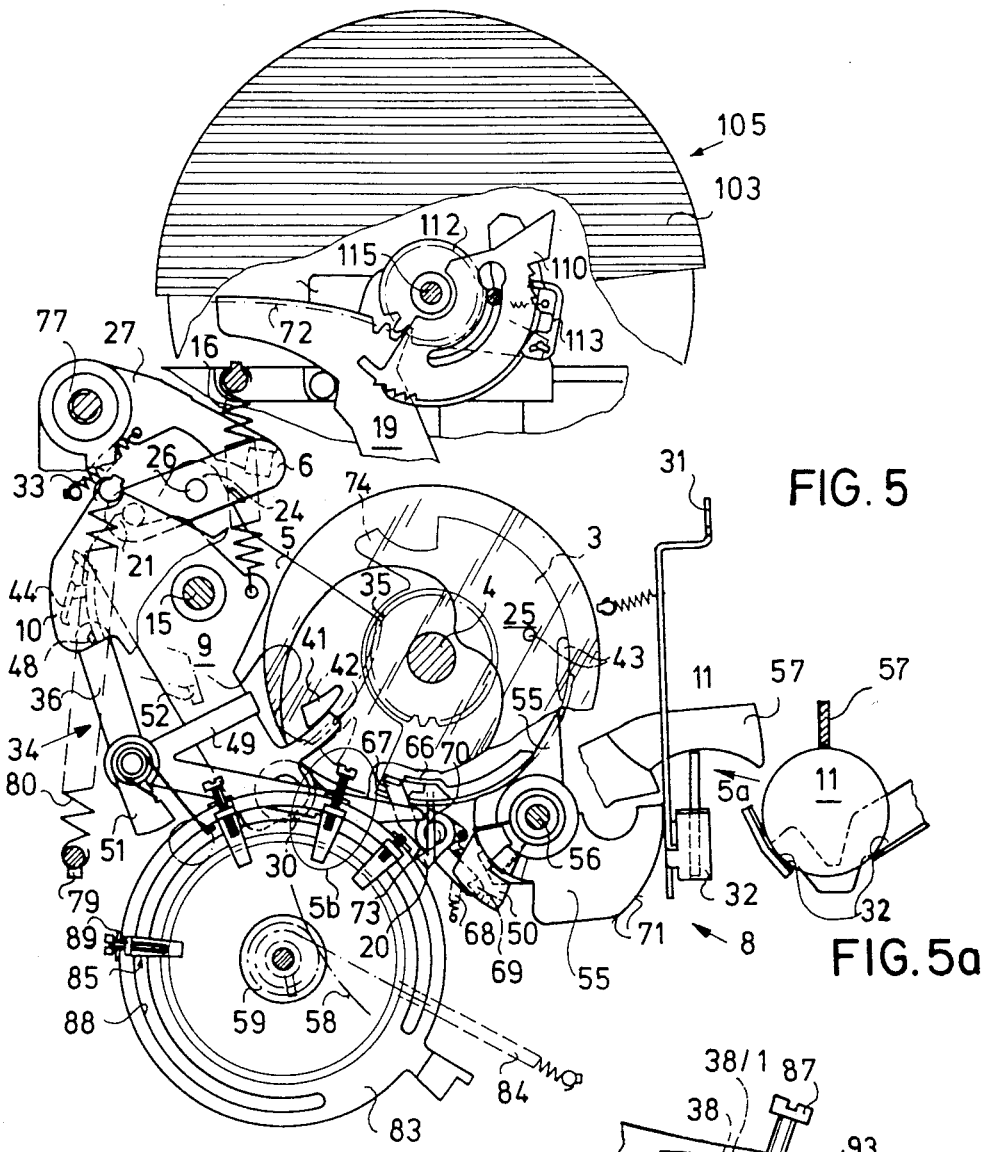
FIG. 5 is a view, similar to that in FIG. 4, however, with the operating mechanism in the final position set by the rotary locking handle and with a coin in the checking position.
FIG. 5*a* is a detail view taken in the direction of arrow 5*a* in FIG. 5.
FIG. 5*b* is a detail view of the encircled portion 56 in FIG. 5.
Figure 6:
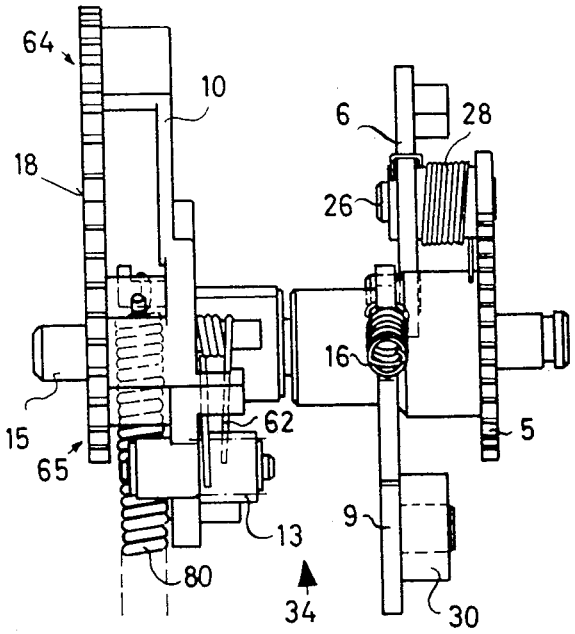
FIG. 6 is a side view of the winding shaft.
Figure 8:
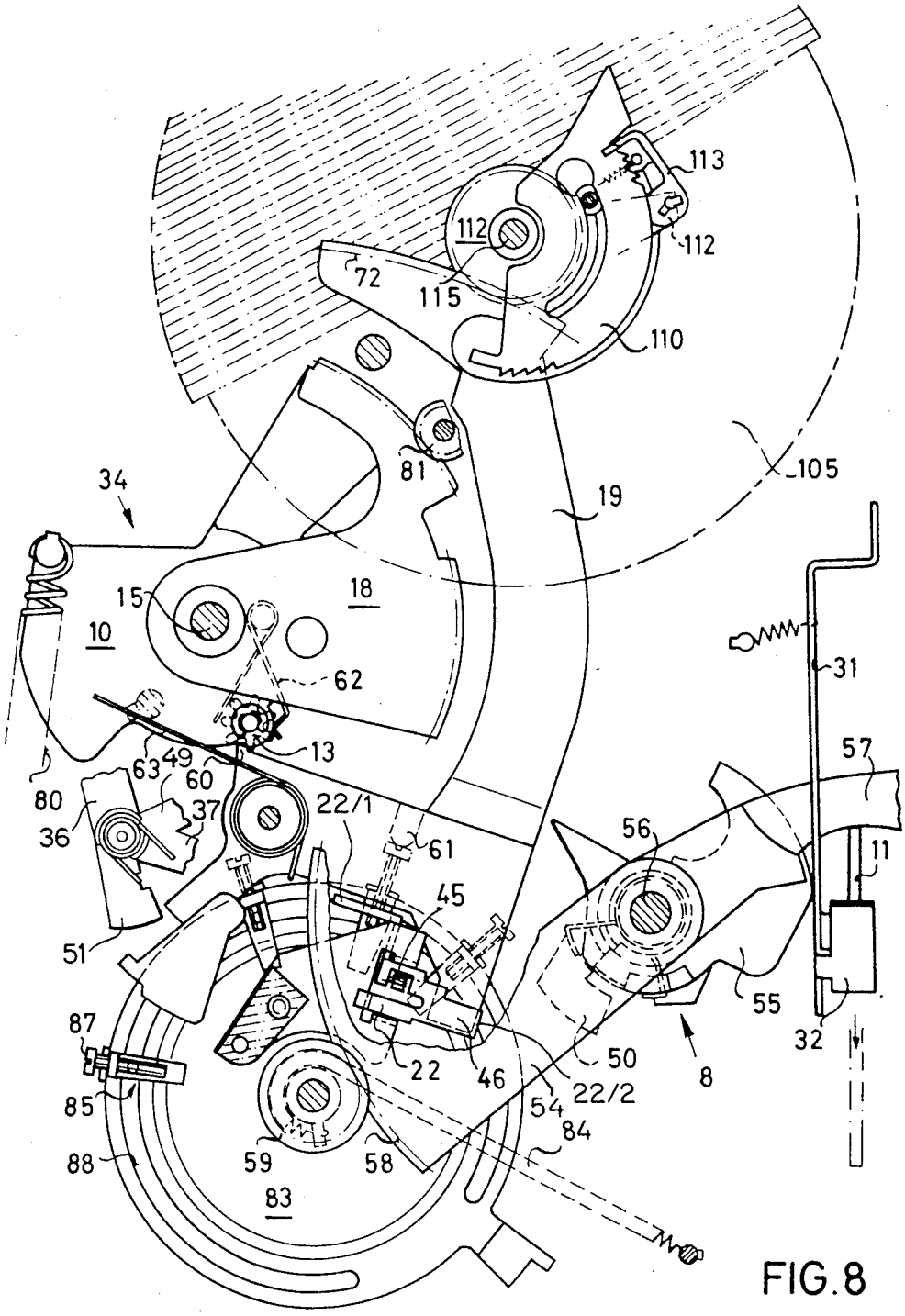
FIG. 8 is an elevational view of the geared engagement between the coin checking device and the parking time period display mechanism.
Figure 10A:
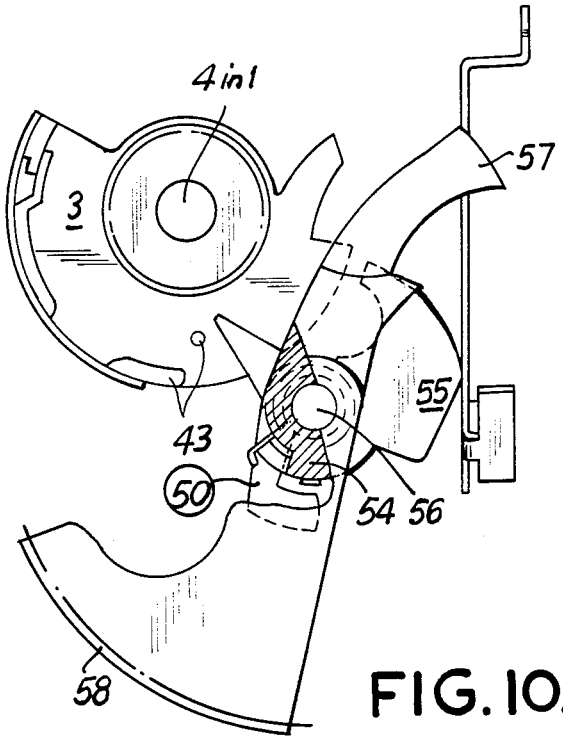
FIGS. 10A and 10B are views of a closing segment, a control disc, and a checking element.
Figure 10B:
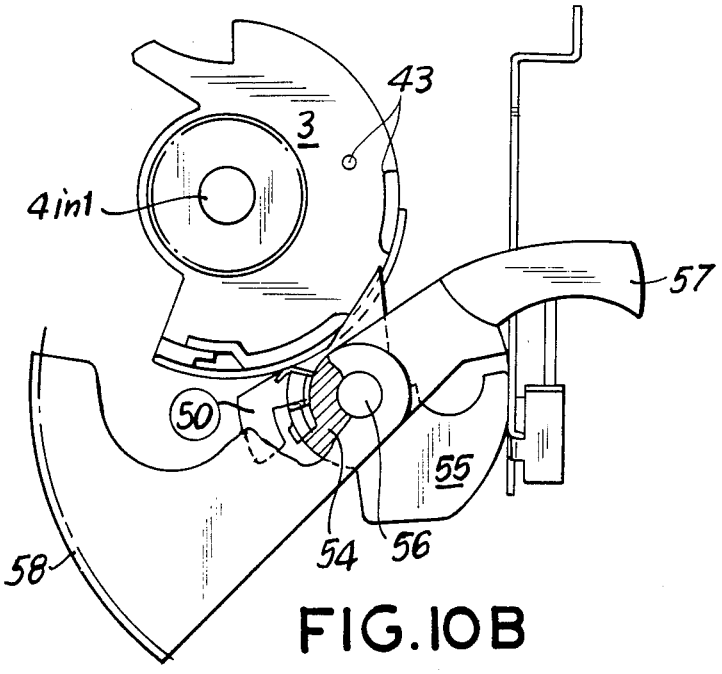
Figure 16B:
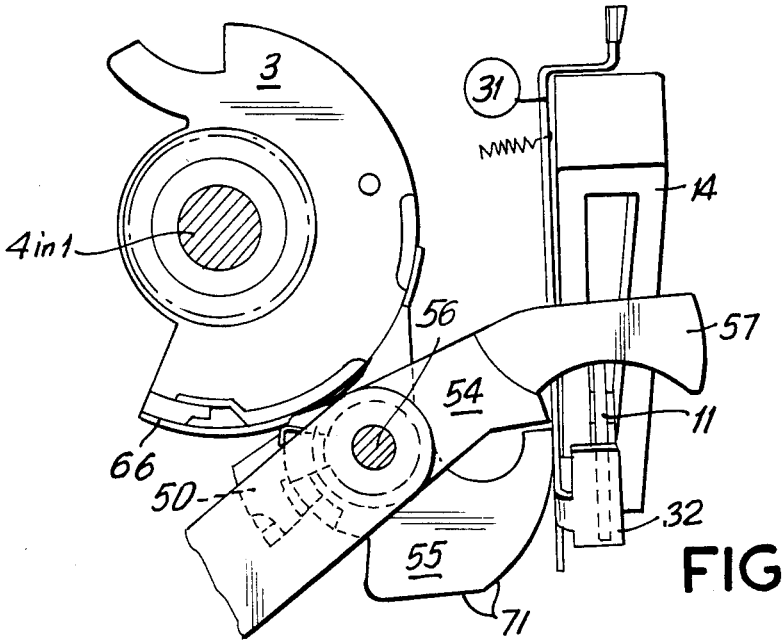

According to the illustrations in FIGS. 5 and 8, the checking element 54 is pivoted clockwise from the starting position shown in FIG. 4 into the final position shown in FIG. 5 when the rotary locking handle is turned, note also FIG. 10A and 10B. The scanning member 57, during the pivotal movement of the element 54, comes into contact with the circumference of a coin 11 positioned in the coin support 32, note FIG. 5 and FIG. 16B. The adjustment position of the scanning member 57, when resting on the circumference of a coin, note FIG. 10B, or the angular distance traversed by the checking segment 54 from its starting position up to the checking position, determines the diameter of a coin 11. For the evaluation of the coin as determined, the toothed segment 58 on the checking segment 54 is in meshed engagement with a gear wheel 59 at a testing disc 83 whereby, if the checking segment 54 is adjusted or set to the diameter of an inserted coin 11, the testing disc is set, against the force of a return spring 84, into a defined locked position, because of the angle of movement of the checking segment and being geared through a determined transmission ratio.

Figure 16C:
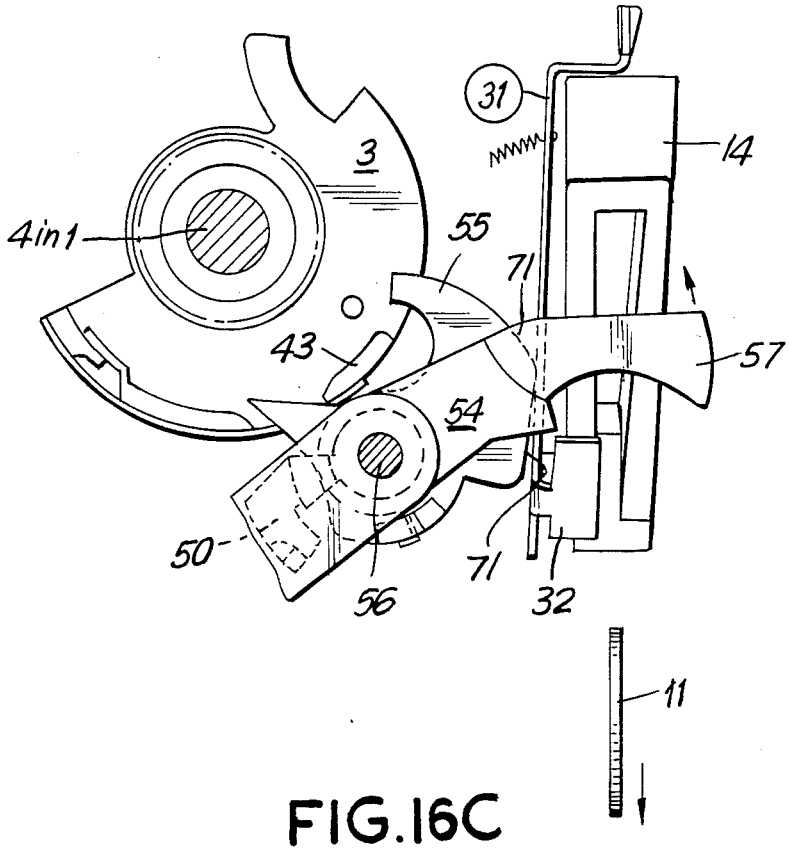

The coin 11 remains in the checking position during the checking phase up to and including the setting of the testing disc into the locked position. This operation is achieved by the control disc 55 made up of a peripheral cam element 71, note FIG. 5, in connection with the pivotal coin lock bar 31 equipped with the prismatic support for a coin 11 in the checking position. After the completion of the checking step, the support is released so that the coin 11 can drop through the coin chute 14 into a coin collection receptacle, see FIG. 16C.

Figure 9A:
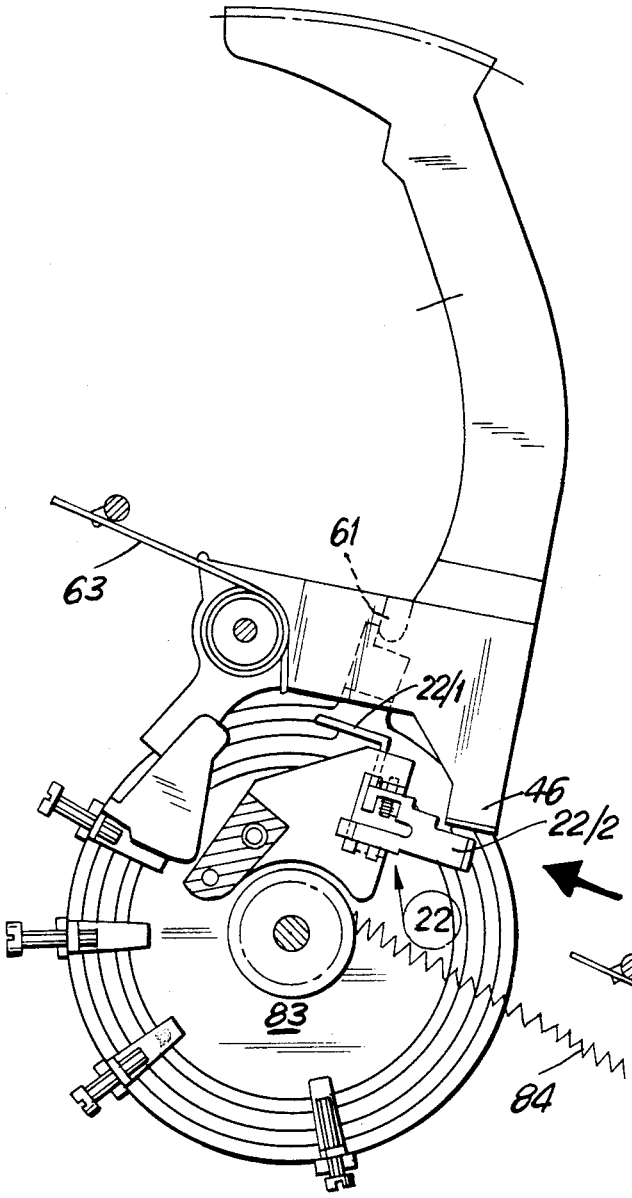
Figure 9C:
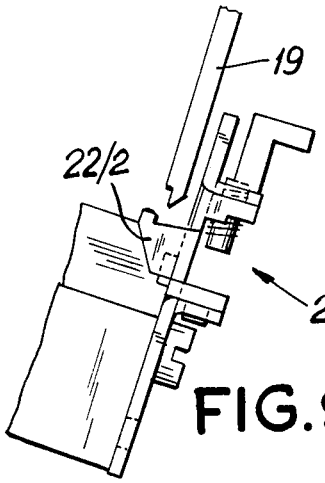
Figure 9B:
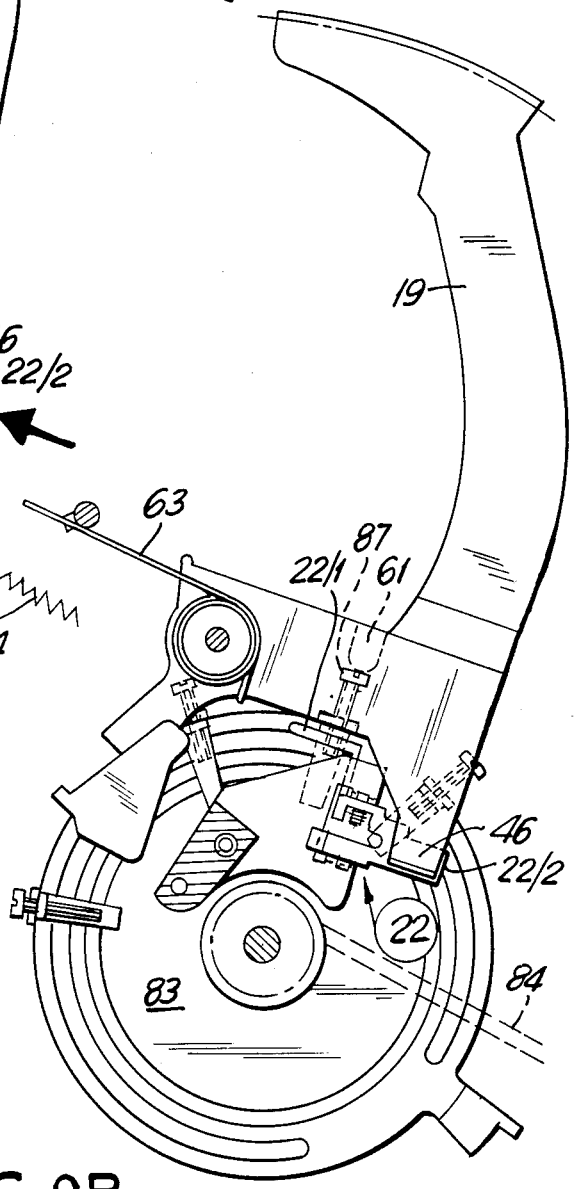
Figure 11A:
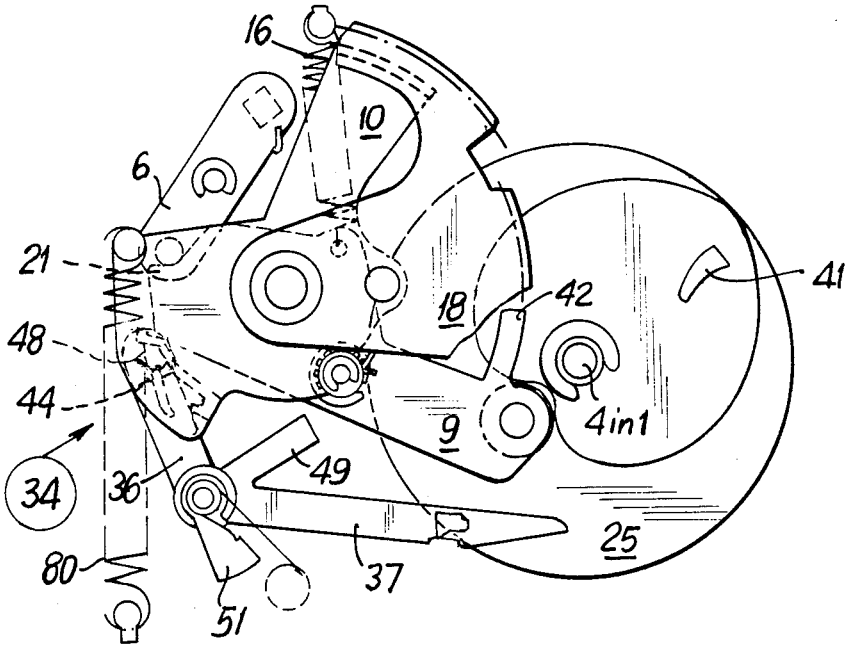
FIGS. 11A and 11B are views of a cam disc, a tilting lever, a lifting segment, an operating segment and a coupling latch.
Figure 11B:
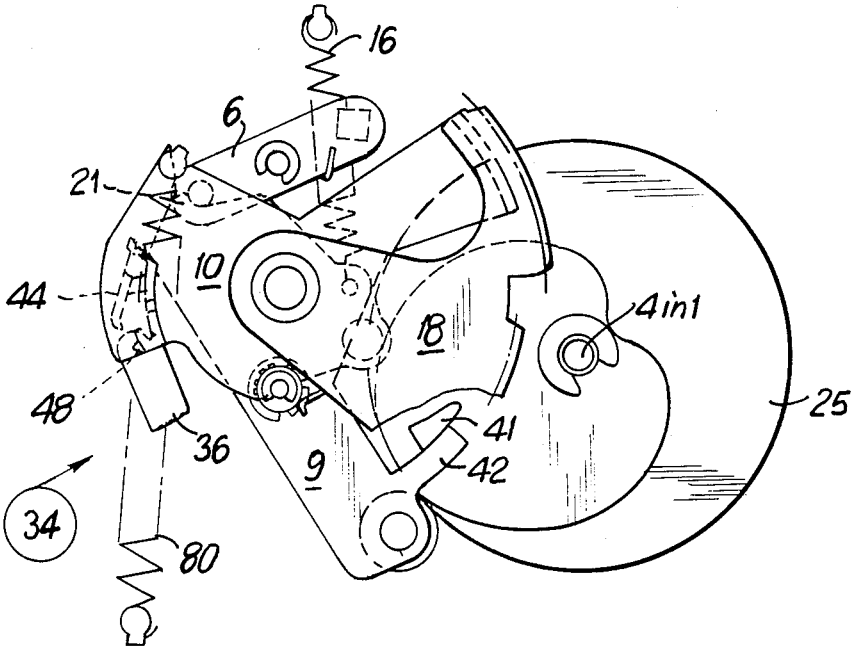
Figure 14A:
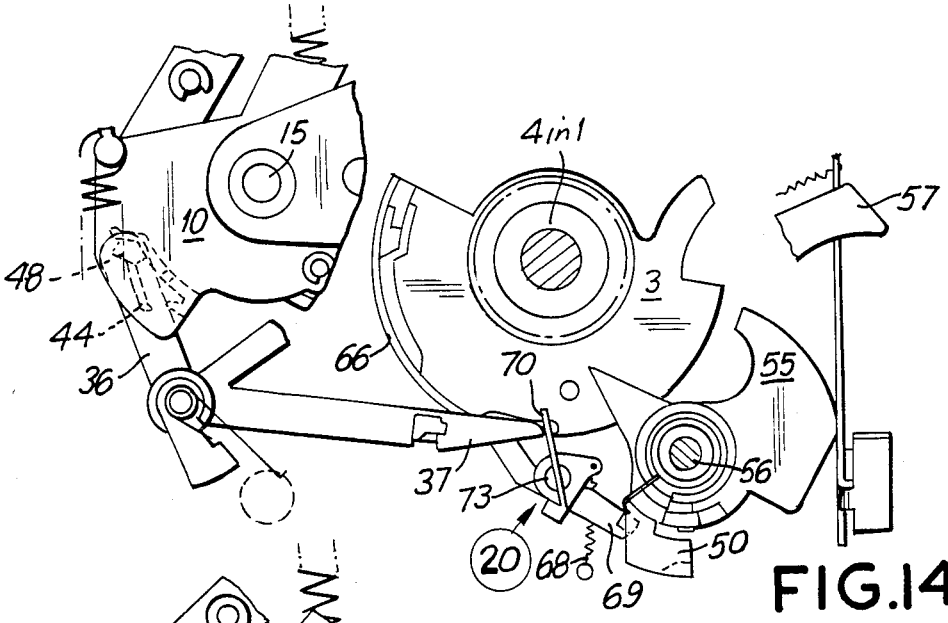
FIGS. 14A, 14B and 14C are views of the operating segment, the locking arm, the closing segment, the control disc and a part of a coin insertion device.

In the coin checking operation, slide contacts 85 adjustable with respect to the coin being used in the meter, are located on the circumference of the testing disc and the contacts include an axially protruding contact pin 86 and a radially adjustable screw 87. Depending on the diameter of the coins being used, the contacts are arranged on the testing disc in the region of the pivotal catching claw 39 located on the locking arm 37, note FIGS. 4 and 5. The slide contacts 85 are adjustable in the circumferential direction of the testing disc so that the adjustment for any diameter coin can be effected. To secure the slide contacts in any position in the circumferential direction, an elongated arcuately shaped slot 88 is provided in the testing disc over the angular extent of the testing region. The contact pin 86 is connected with an angular member 89 and has a threaded shaft 90 inserted from one side through the arcuately shaped opening 88 in the testing disc 83. From the opposite side a strip shaped clamping piece 93 is provided which fixes the slide contact 85 on the testing disc 83 by a nut 94 in threaded engagement with the shaft 90, see FIG. 2. In an angle portion of the angle member 89, a threaded bore 95 is provided which receives the radially adjustable screw 87. The duration of the time period selected for a coin is set by the radial adjustment of the screw 87. At the same time that the rotary handle is actuated, the checking element 54 adjusts itself to the coin 11 for determining the coin diameter, note FIG. 5. The angular movement of the checking element 54 due to its meshed engagement with the gear wheel 59 via the segment 58, is transferred to the testing disc 83. Disc 83 assumes a precise location depending on the coin diameter and rotates the slide contact 85 associated with the coin 11 being tested and the contact pine 86 is moved into the region of the pivotal catching claw 39 on the locking arm 37. After the actuation of the rotary handle is completed, and the operating cycle of the operating mechanism 34 is released, the locking arm 37 with the claw 39, controlled by a link 44 on the operating element 10 and a lever arm 36 on the locking arm 37 pivots into engagement with the contact pin 86 on the slide contact 85 and stops the testing disc 83 in the time release position. The actuation of the rotary handle 2 ends or is limited by contact of the cam 41 on the cam disc 25 at the abutment lever arm 42 on the tilting lever 9, note the corresponding position in FIG. 5. If the rotary handle is released, it returns, due to the action of spring 16 on the lever 9, into its original position. If the rotary handle is released, the disengagement of the rotary handle drive occurs by lift-off of the coupling latch 6. Next, the force of the previously stressed force accumulator comes into effect and drives, through the operating segment 10 and the link guide 44, the operating mechanism 34 and releases the locking arm 37, note FIG. **5*b*. The initial position of the operating mechanism is shown in FIG. 4 as well as in FIGS. 11A and 14A. If the operating mechanism 34 is turned by the knob 2 completely against the lever arm 42, the spring or force accumulator 80 is stretched and the tilting lever and the operating segment 10 are rotated into the position in FIG. 5 as well as in FIGS. 11B and 14B. In this position the counterclockwise rotation of the tilting or winding lever 9 and the operating segment commences. In this position, however, the control finger 48 on the lever arm 36 of locking arm 37 has moved off the link guideway 44, note FIGS. 4, 14A and 14B, into the position displayed in FIGS. 5 and 14C, so that the lever arm 36 and the locking arm 37 rotate clockwise whereby the catching claw 39 engages the angular member 89. The movement of the lever arm 36, the locking arm 37, the control lever 49 and the control arm 51 consisting of a unit is controlled by the control finger 48 on the lever arm 36 into the link guideway 44 on the operating segment 10.In the time release position, screw 87 is in synchronous driving connection with the safety flap 22 via its screw shaft and the flap is pivotally supported on the rear plate 76. In the release position, if a proper coin has been inserted, the contact pin 86, note FIG. 5*b*, with the pivotal catching claw 39 is held fixed. The threaded shaft on the screw 87 located in the retention position presses on the pivotal safety flap 22 so that the stop 46 at the lower end of the setting segment 19 is freed and the pivotal adjustment of the setting segment can perform a time set-up. The lower end of the threaded shaft 87 on the screw 87 during the scanning of the coin pivots the safety flap 22 in such a way that element 22/1 is swiveled out of the plane of FIGS. 4 and 8 while element 22/2 is pivoted into the plane of FIGS. 4 and 8. When this occurs, the stop 46 or the setting segment 19 is released and the setting segment 19 can adjust itself in contact with the stop cam 61, note FIG. 8. The contact by the screw 87 pivots the safety flap out of a locking position maintained by torsion spring 45 and releases a setting segment 19 pivotally supported on the rear plate 76 for setting the allotted parking time. If the testing disc is not in a stop position for a coin relative to the catching claw 39, then the safety flap positions itself under the stop 46 on the setting segment 19 and prevents any time setting action of the setting segment in the clockwise direction as shown in FIG. 8. Note the relation of the testing disc 83 and the setting segment 19 in FIGS. 9A and 9B**.

The catching claw 39 includes a locking lug 47 formed as a single member with the locking arm 37 and an adjustable locking lug 38 insertable into an elongated slot 38/1, note FIG. **5*b*. By means of the adjustable locking lug 38**, the claw opening can be set to several tolerance widths or steps so that the diameter tolerance range of the coins can be set for the catching claw.

To facilitate resetting of the testing disc 83 for a different range of coins 11, markings 82, note FIG. 1, have been provided an uniform intervals on the surface of the testing disc and represent a correlation between a sliding contact 85 and a specific coin diameter so that the adjustment of the sliding contacts for particular diameters can be easily effected.

For conversion of the arrested position of the testing disc 83, based on a given coin, into a corresponding allotted parking time period, the pivotally supported setting segment 19 is provided on the rear plate 76. The setting segment 19 includes an operating tooth 60 in meshed engagement with a pinion 13 located on the operating segment 10 and secured by a friction spring 62, note FIGS. 6 and 8, whereby the pinion 13 engages the tooth 60 and drives the setting segment 19 counter to the biasing action of a return spring 63. A stop cam 61 is provided on the setting segment 19 and contacts the screw 87 of a sliding contact 85 on the testing disc 83 for the purpose of determining the setting angle assigned to an inserted coin 11 when the setting segment 19 is actuated in the clockwise direction as shown in FIGS. 5 and 8. Overtravel of the operating segment 10 beyond the assigned setting angle of the setting segment 19 does not have any effect, since after the abutment of the setting segment 19 with the screw 87, the friction of the pinion 13 is overcome. Blocking of the operating sequence is prevented, because if a higher torque is developed, the small pinion rotates through one tooth pitch and becomes disengaged from the operating tooth 60.

For the correct phase control for the locking arm 37 during the setting and operating sequence of the operating mechanism 34, the operating segment 10 comprises a link guideway 44 with a control finger 48 extending into the guideway. Control finger 48 is located on lever arm 36 on the locking arm 37 and, simultaneously with the locking arm 37, pivots a control lever 49 formed as a unit with the locking arm.

The link guideway 44 or link 44 controls the sequence of motion of lever arm 36, the locking arm 37, the control lever 49, and the control arm 51, all of which are formed as a unit. During the movement of the link 44 at the switching segment 19, the control finger 48, slides along he external cam track so that the positions of elements 36, 37, 49 and 51 are somewhat swivelled counter-clockwise from the position in FIG. 4, until the locking arm 37 rests on the arm 70 which is flexurally pivotal to the left. At the end of the winding-up movement by the rotary handle, the pawl or locking latch 20 falls off, note FIG. 5, and releases the locking arm 37 by swiveling the arm 70 toward the right and the control finger 48 falls off the inner track of the link 44. Accordingly, the catching claw 39 enters into engagement with the pin 86, note FIGS. 5 and 5*b*, simultaneously the lever 49 releases the lug 52 of the release lever 27 and the arm 51 swivels leftward, note FIG. 8, and unlocks at 19/1 the switching or adjustment segment 19 so that it can swivel clockwise until it contacts element 61 on the screw 87. Control finger 48 also pivots a control arm 51 for the purpose of unlocking the release lever 27 and the setting segment 19. The control arm 51 releases the setting segment 19 as the control finger 48 drops off the inner link guide 44, note FIG. 5, then the locking arm 37 pivots clockwise and releases the lower end of the setting segment 19 for the clockwise rotation. Note FIGS. 4 and 12A showing the starting position of the various parts illustrated with the setting segment 19 including the arm 19/1. In the FIG. 12A position the control arm 51 blocks the arm 19/1 of the setting segment 19 preventing clockwise movement of the setting segment 19. When the control finger 48 falls from the outer link guideway 44 to the inner link guideway 44, see FIGS. 5 and 14C, the control arm 51 and the parts pivot clockwise and the control arm pivots to the left so that the setting segment 19 or arm 19/1 can rotate clockwise. It is required for the unlocking operation that the rotary locking handle 2 is rotated through a full cycle until it reaches its stop position. During the unlocking of thr release lever 27, a lug 52 on the release lever 27 is freed during the operational cycle and the release lever, biased by the spring 33, undergoes an angular movement in the clockwise direction as viewed in FIG. 5. At the same time, a blocking bracket 53 on the release lever 27 is disengaged from a control gear unit 81, note FIG. 3, located on the rear plate 76. When the lug 52 is released then the release lever 27 pivots and correspondingly the blocking bracket 53 moves in the clockwise direction and releases the control gear unit 81, note FIG. 3, which controls the operating mechanism 34.

As has been mentioned, the lifting or tilting segment 18 which is rigidly connected with the operating segment 10 is also pivoted by the rotation of the rotary locking handle 2. A first toothed section 64 and a second toothed section 65 are provided on the tilting segment 18 with the first toothed section 64 in engagement with the control gear unit 81 for the purpose of controlling the sequence of the operating mechanism. The second toothed section is in driving connection with a winding wheel 92, note FIGS. 3 and 4, of the parking time period mechanism 91. The winding wheel 92 is rotatably supported on a drive assembly shaft 96, note FIG. 2. An axially displaceable crown wheel 98 is also positioned on the shaft 96 so that it rotates with the shaft and is equipped with ratchet teeth and in the winding direction is carried by the winding wheel 92 also equipped with ratchet teeth 99. As a result, the shaft 96 rotates and, during the turning or rotating process by way of the rotary locking handle 2, it winds a drive assembly spring, not shown, through the two winding-up gears 100, 101 designed as an interchangeable gear set. The drive assembly spring is wound up with each rotational cycle of the handle and it is designed as a drag spring. The parking time period mechanism 91 is in engagement with the gear wheel 102, note FIG. 3, via a drive shaft 109 and a gear wheel 108 and further by a stepped-up gear formed by two gear wheels 106, 107 rotatably supported on the rear plate 76. Gear wheel 102 is frictionally connected with a time period disc 105. The parking time period mechanism 91 by means of the previously described gear train, drives the time disc from a set parking time period into the starting position.

The control gear unit 81 controls the sequence of the operating mechanism 34 by an anchor on the gear unit 81 which regulates the cycle velocity of the operating mechanism. The control gear unit 81 is in engagement with the toothed segment 64 on the tilting segment 18, through a gear which identified with 81 in FIG. 8, which is not rotatably connected with the operating segment 10 and which is powered by the force accumulator 80. The action of the force accumulator is braked by the correction to the control gear unit 81 and, therefore, proceeds slowly.

Figure 3:
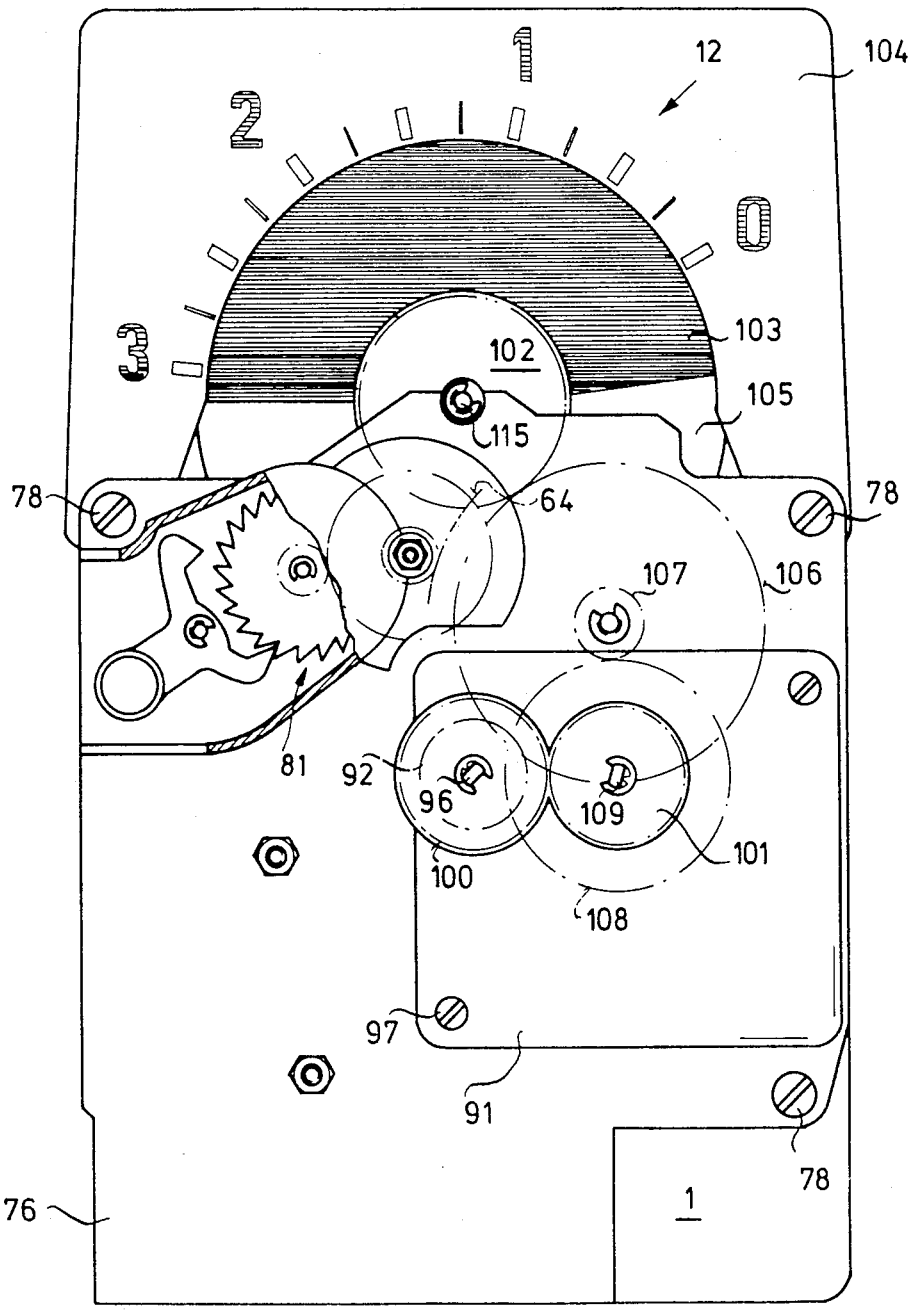

The winding wheel 92, note FIGS. 2, 3 and 4, is not mounted on the same shaft 4 as the rotary handle 2, rather it is on the drive assembly 96. The shafts 4 and 96 appear aligned with one another, but operate separately.

Figure 12B:
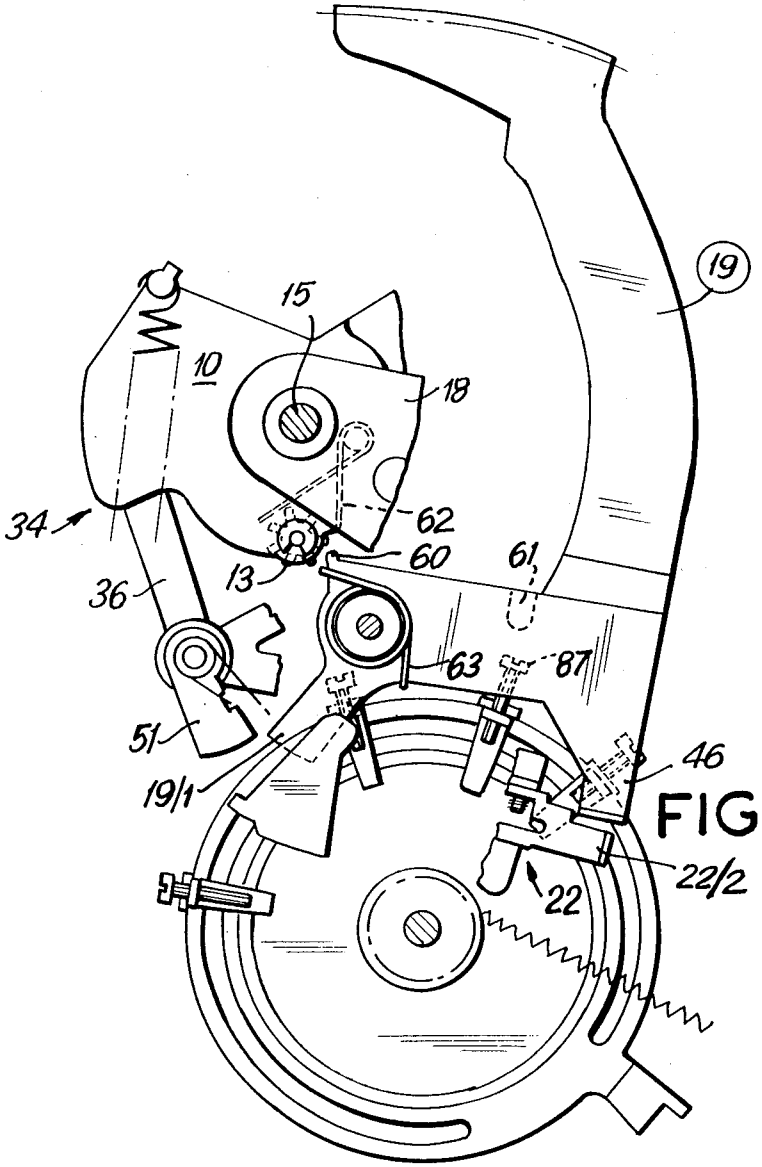
FIGS. 12A and 12B are views of the testing disc and setting segment shown in FIGS. 9A, 9B and 9C along with parts of the operating segment, the lifting segment and a control arm.
Figure 12A:
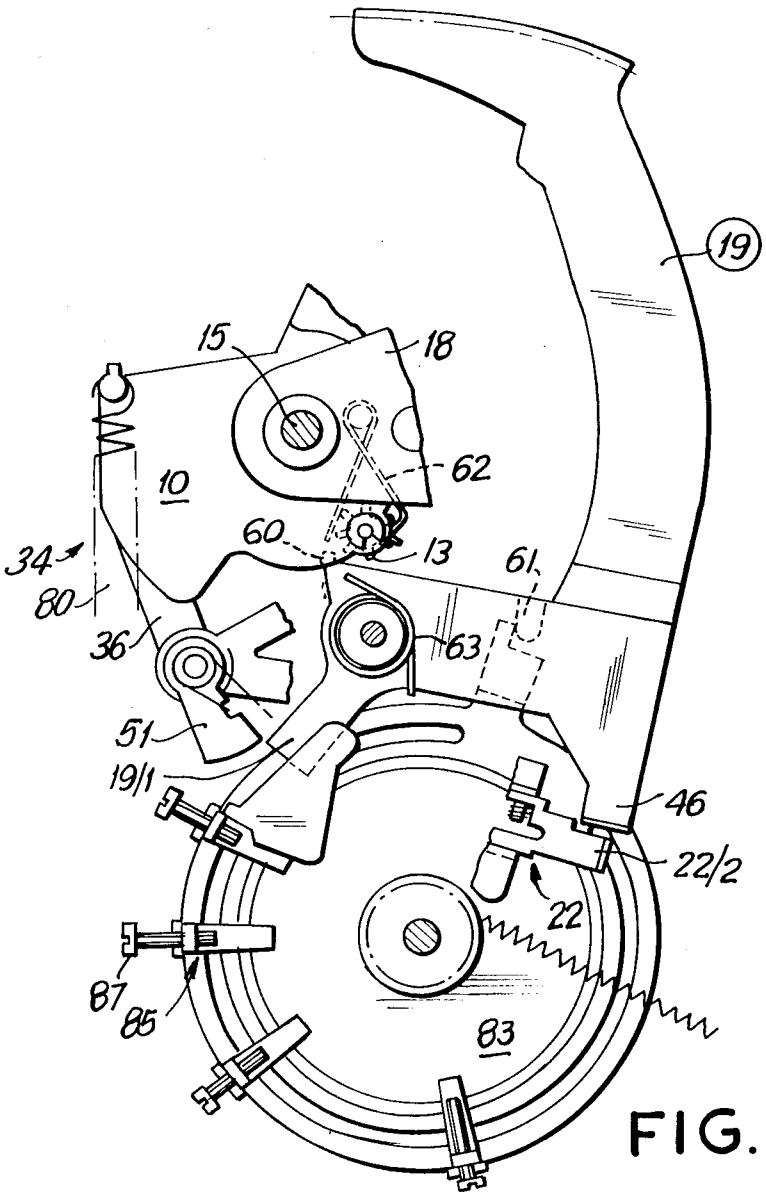

The elapsed time period is set by the setting segment 19 which, after its release, traverses a specific angular path until it rests by means of a stop cam 61 against a screw 87 on the testing disc 83, see FIGS. 12A and 12B. The setting segment 19 includes a toothed segment 72 in engagement with an operating wheel 112, note FIG. 8. If the setting segment 19 moves in the clockwise direction as viewed in FIG. 8, then the wheel 112 is rotated and carries with it an operating latch 13 located on the operating wheel 112. The operating wheel 112 is fitted loosely on a common axis 115 on which the time disc 105 is positioned. A replaceable operating cam 110 is screwed on to the time disc 105 and the latch 113 engages with the operating cam 110 for setting a time period. The time disc 105 can be adjusted relative to the gear wheel 108 by a frictional connection. The latch 113, note FIGS. 1, 2, 4, 5 and particularly FIG. 8, is supported on a cantilever arm of the wheel 112 and during a time set up is rotated by the toothed segment 72 at the segment 19 in the counterclockwise direction, see FIG. 8. Accordingly, the latch 113 engages into the teeth of the disc or operating rack 110 which is rigidly connected by means of screws with the time disc 105 and adjusts the time disc in accordance with the angle of rotation determined by the coin scanning. Parts 19, 112 and 113 then return to the position illustrated in FIG. 4. Accordingly, the latch 113 ratchets clockwise over the teeth of the operating rack 110 and displaces time disc 105 through an additional time display segment.

Figure 14B:
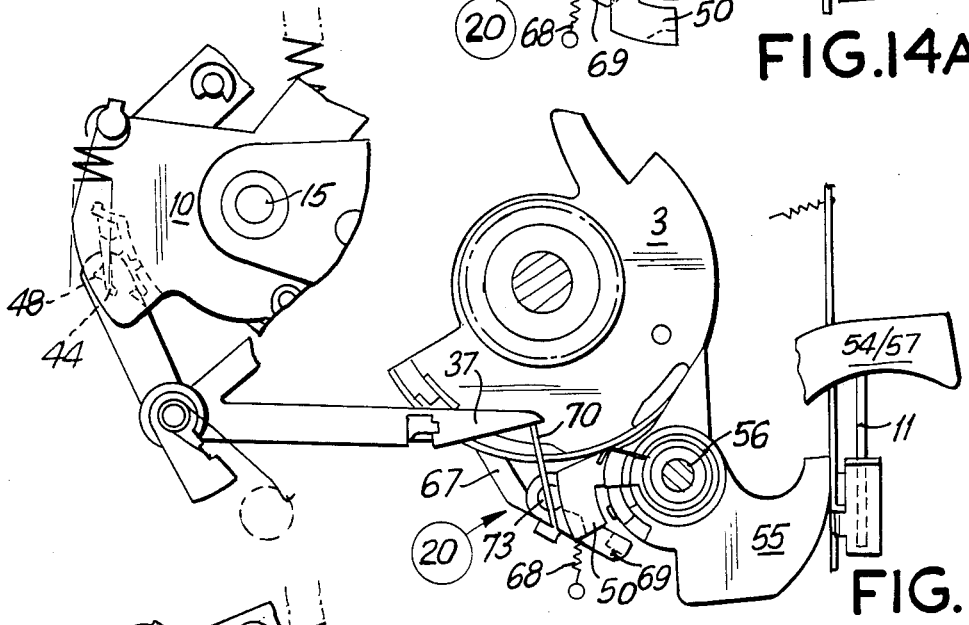
Figure 14C:
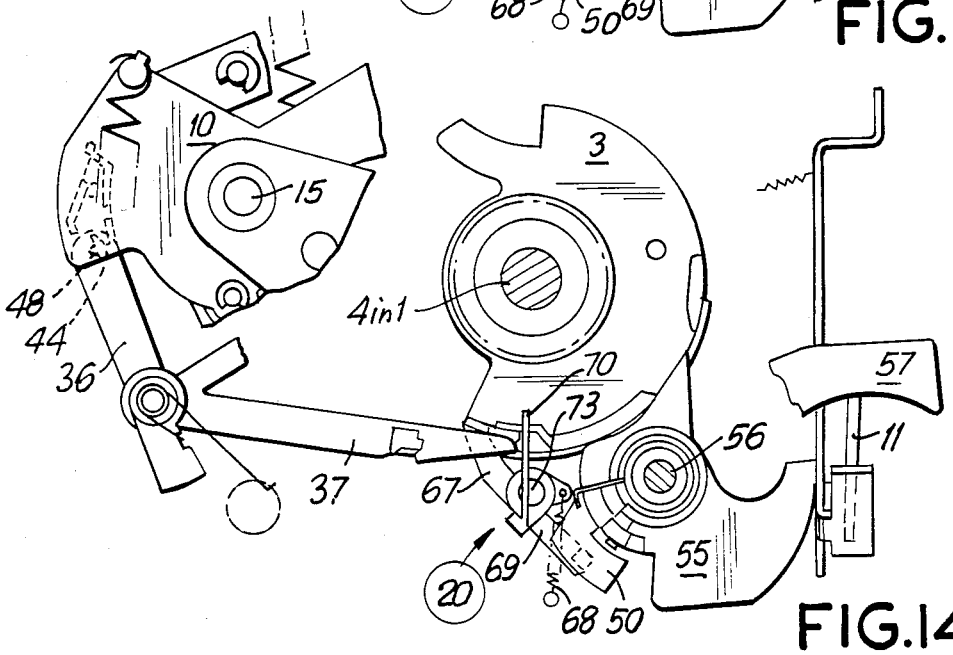

For the correctly phased control of the coin checking process, the closure segment 3 is provided with a cam 66 which controls by a lever arm 67 in correct phase sequence, a double-acting locking latch 20 biased by a spring 68 during the turning and return movement of the rotary handle 2. A locking arm 69 on the locking latch retains the checking element 54 in the coin checking position by way of the coupling socket 50. Further, a biased latch arm 70 is located at the locking latch 20 and blocks the entry of the locking arm 37 with its catching claw 39 and effects movement of a set contact pin 86 into the arrested position only at the end of an operating phase. The arrested position is achieved in the following manner. Note FIG. 5 and particularly FIGS. 14A, 14B and 14C where the biased latch arm 70 of the locking latch 20 is shown in three different positions. The starting position is set forth in FIG. 14A. In FIG. 14B, the operating segment 10 rotates clockwise and the control finger 48 is moved to the left due to contact with the link guideway 44 and the locking arm 37 rotates counter-clockwise over the latch arm 70. Subsequently the latch arm 70 pivots to the left and positions itself under the locking arm 37, note FIG. 14B. The lever arm 67 at the locking latch 20 is biased on the cam 66 of the closing segment 3 by the spring 68. In FIG. 14C, the operating segment is in the outermost clockwise position and at the same time the closing segment 3 has moved to the most counter-clockwise position, and the lever arm 67 under the force of the spring 68 contacts the cam 66 and pivots the latch arm 70 to the right, releasing the locking arm 37. Then the locking arm 37 rotates counter-clockwise until control finger 48 rests on the link guideway 44 and the catching claw 39 arrests the set contact pin 86. The locking latch 20 is pivotally supported on a lug 73, see FIG. 5, located on the front plate 1. The biased latch arm and the locking latch assembly work in the following manner, the locking latch 20 is rotatably supported on a pin in the front plate 1 and is moved clockwise by a spring 68, note FIG. 4. In the normal position the lever arm 67 rests upon the cam of the segment 3. If the rotary handle 2 is rotated, then the segment 3 rotates into the position shown in FIG. 5. The lever arm 67 of the latch 20 moves off the control cam 66 and the arm 69 fixes the coupling socket 50 and with it the checking element 54 in the coin checking position. The biased latch arm 70 positions itself below the locking arm 37, if the checking segment 54 has rotated the locking arm 37 by means of the control finger 48. The latch arm 70 prevents the movement of the locking arm 37 with the catching claw 39 as long as the rising portion of the cam 66 lifts the lever arm 67 in the clockwise direction and pivots away the latch arm 70 so that the locking arm 36 can move into position for arresting the disc 83. The latch arm 70, note FIGS. 14A, 14B and 14C, at the locking latch 20, is positioned below the locking arm 37, see FIG. 14B. The testing or checking segment 54 in the coin checking position in FIG. 5 is also retained by the locking arm 69 at the locking latch 20 through the coupling socket 50. Latch arm 70 prevents movement of the locking arm 37 until the lever arm 67 at the locking latch 20 moves from its outer contact with the cam 66 into contact with the inner contact surface, note FIGS. 5 and 14C, which takes place at the end of the winding of the handle 2. The biased latch arm 70 of the locking latch 20 then pivots in the clockwise direction, and the locking arm 37 can rotate clockwise until the control finger 48 on the lever arm 36 rests on the inner control curve of cam 44, see FIGS. 5 and 14C, and the locking arm 37 can move into position for retention of the checking disc 83.

In completion the closing segment 3 is in meshed engagement, via cantilever 74, with a lever 75, note FIG. 4, and the lever is pivotally supported on the front plate and engages a malfunction indicator shield 23 movable into a malfunction indicating field, so that should the closing segment 3 be moved from the starting position through the entire winding and return operating cycle of the operating mechanism, the malfunction indicator shield 23 remains visible in the malfunction indicator field.

While specific embodiments of the invention have been shown and described in detail to illustrate the application of the inventive principles, it will be understood that the invention may be embodied otherwise without departing from such principles.

We claim:

1. Manually actuated, self-collecting parking meter comprising a coin insertion device, a coin checking device for receiving coins of different diameters from said coin insertion device and checking the diameter of the coin, a rotary locking handle having a rotation cycle and arranged to place said coin insertion device in operation, and a parking time period display mechanism operable on the basis of the coin inserted into said coin insertion device after said rotary locking handle has been actuated, wherein the improvement comprises a first shaft (4) connected to and rotatable by said rotary locking handle (2), a heart-shaped cam disc (25) secured on said first shaft (4) for rotation therewith, an axle (15), a tilting lever (9) mounted on said axle and in engagement with said cam disc, said tilting lever in operable engagement with said coin checking device (8), a first toothed segment (5) secured on said axle (15) for rotation therewith, a coupling latch (6) on said first toothed segment (5) and engageable with said tilting lever (9) so that by turning said handle (2) in either rotational direction said tilting lever (9) is displaced for operating said coin checking device, a force accumulator (80) arranged to be loaded by said tilting lever when said tilting lever is displaced for operating said coin checking device, an operating mechanism (34) in operable engagement with said coin checking device, means in engagement with said force accumulator (80) and said operating mechanism, so that at the end of the rotation cycle of said handle said force accumulator automatically drives said operating mechanism for effecting the operation of said coin checking device and for setting said parking time period display mechanism.

2. Manually actuated, self-collecting parking meter, as set forth in claim 1, wherein said coin insertion device is closeable.

3. Manually actuated, self-collecting parking meter, as set forth in claim 1, wherein said tilting lever (9) is rotatably supported on said axle (15) and continuously rests in contact with the circumferential periphery of said cam disc, a spring (16) in engagement with said tilting lever for biasing said tilting lever against said cam disc whereby when said cam disc (25) is rotated from the starting position in either direction, the tilting lever (9) is pivotably displaced by the same amount in one direction of movement.

4. Manually actuated, self-collecting parking meter, as set forth in claim 1, wherein said toothed segment (5) is mounted coaxially with said tilting lever (9) on said axle (15) for rotation with said axle, said toothed segment includes a cantilevered arm (24), a support bolt (26) located on said cantilevered arm, said coupling latch (6) is rotatably supported on said support bolt, a follower lug (21) located on said tilting lever (9), and a first spring (28) in engagement with said follower lug (21) controls said coupling latch (6).

5. Manually actuated, self-collecting parking meter, as set forth in claim 4, wherein said coupling latch (6) is a twin lever having a first lever arm and a second lever arm, a multi-arm release lever (27) in contact with said first lever arm on said coupling latch, said release lever is rotatably supported, a second spring 33 biases said release lever so that, when said handle (2) and said tilting lever (9) with said coupling latch (6) is at the end of the rotation cycle of said handle, said release lever (27) drops onto said coupling latch (6) and disengages said latch from said follower lug (21) on said tilting lever (9).

6. Manually actuated, self-collecting parking meter, as set forth in claim 1, wherein said toothed segment (5) is secured to said axle for rotation therewith, an operating segment (10) and a lifting segment (18) are secured on said axle for rotation therewith and are pivoted with said axle when actuated by said tilting lever (9).

7. Manually actuated, self-collecting parking meter, as set forth in claim 3, including a closing segment (3), said toothed segment (5) is in meshed engagement with said closing segment, a front plate, a hub attached to said front plate, and aid closing segment is rotatable supported on said hub.

8. Manually actuated, self-collecting parking meter, as set forth in claim 7, wherein said closing segment (3) comprises a follower (43), said coin checking device (8) includes a central disc (55), a second shaft (56) rotatably supporting said cam disc, a back plate (76), said cam disc located between said front plate and said back plate, and said closing segment (3) engages said cam disc (55) when it is rotated.

9. Manually actuated, self-collecting parking meter, as set forth in claim 8, wherein said coin checking device includes a checking element (54), a torsion loaded coupling socket (50) located on said cam disc (55), said cam disc (55) drives said checking element (54) by said coupling socket (50), said checking element is a twin lever having a first arm forming a contact member (57) and a second arm forming a second toothed segment (58).

10. Manually actuated, self-collecting parking meter, as set forth in claim 9, including a testing disc (83), a gear wheel (59) located on said disc (83), said toothed segment (58) of said checking element (54) meshes with said gear wheel (59) so that with said checking element (54) adjusts to the diameter of a coin inserted into the meter, said testing disc is set in a specific locked position due to the angular displacement of said checking element (54) transmitted through a determined stepped-up gear ratio.

11. Manually actuated, self-collecting parking meter, as set forth in claim 9, wherein said cam disc (55) includes a peripheral cam element (71), a pivotal coin lock bar (31) engageable with said peripheral cam element (71), said coin lock bar (31) includes a coin support (32) for receiving a coin in a checking position and after the coin is checked it is released by said cam disc (55) and displaced from said support (32) so that the coin can fall through a coin chute (14).

12. Manually actuated, self-collecting parking meter, as set forth in claim 9, including a testing disc having a circumference, wherein adjustable slide contacts are mounted on the circumference of said testing disc (83), said slide contacts include an axially protruding contact pin (86) and a radially adjustable screw (87) arranged to project outwardly from the circumferential periphery of said testing disc, a locking arm (37), a catching claw (39) on said locking arm (37), and said catching claw (39) located in the path of said adjustable screws (87) on said testing disc (83).

13. Manually actuated, self-collecting parking meter, as set forth in claim 12, wherein a safety flap (22) is pivotally supported on said rear plate (76), a setting segment (19) pivotally supported on said back plate, and said screw (87) on said sliding contact (85) when arrested by said catching claw (39) pivots said safety flap (22) and releases said setting element (19) for setting the allotted parking time period for said sliding contact.

14. Manually actuated, self-collecting parking meter, as set forth in claim 12, wherein said catching claw (39) comprises a lock (47) formed as a unit with said locking arm (37) and an adjustable locking lug (38) so that by means of said locking lug (38) said claw opening can be adjusted to a number of tolerance steps depending upon the diameter tolerances of a coin.

15. Manually actuated, self-collecting parking meter, as set forth in claim 12, wherein setting marks (82) are provided at uniform angular intervals on the circumference of said testing disc (83), and said setting marks (82) provide an identification for setting said sliding contacts (85) for a specific coin diameter and facilitate the location of said sliding contacts (85) on said testing disc (83).

16. Manually actuated, self-collecting parking meter, as set forth in claim 13, wherein said setting segment (19) comprises an operating tooth (60), a pinion (13) in meshed engagement with said operating tooth, an operating segment (10), said pinion located on said operating segment (10), a friction spring (62) securing said operating tooth (60) in position, so that said pinion (13) in engagement with said operating tooth (60) drives said setting segment (19) against the action of a return spring (63).

17. Manually actuated, self-collecting parking meter, as set forth in claim 16, wherein a stop cam (61) is located on said setting segment (19), said stop cam (61) is arranged to contact with said screw (87) of said sliding contact (85) on said testing disc (83) in the stop position, for the purpose of limiting an setting angle assigned to a specific coin diameter, by overcoming the friction at said pinion (13).

18. Manually actuated, self-collecting parking meter, according to claim 6, wherein said winding segment comprises a first toothed section (64) and a second toothed section (65), a control gear unit *81) for controlling the sequence of said operating mechanism (34), a parking time mechanism (91) including a winding wheel (92), said first toothed section (64) arranged to engage said control gear unit (81) for controlling the operating mechanism, and said second toothed section

(65) is in driving connection with said winding wheel (92).

19. Manually actuated, self-collecting parking meter, as set forth in claim 7, wherein a lever (75) is in meshed engagement with said closing segment (3), said lever (75) is pivotally supported at said front plate (1), a malfunction indicator shield (23) is in engagement with said lever (75) for moving said shield into a malfunction indicating field so that if said closure segment is moved from the starting position through a complete operating sequence of said operating mechanism (34), said malfunction indicator shield (23) remains visible in the malfunction indicator field.

* * * * *